US010240320B2

(12) United States Patent
Bellin et al.

(10) Patent No.: US 10,240,320 B2
(45) Date of Patent: Mar. 26, 2019

(54) DIGGING METHOD AND ASSEMBLY FOR LAYING A PIPELINE IN THE BED OF A BODY OF WATER

(75) Inventors: Massimo Bellin, Mestre (IT); Giovanni Massari, Venice (IT); Paolo Bonel, Venice (IT)

(73) Assignee: SAIPEM S.p.A., San Donato Milanese (IT)

( * ) Notice: Subject to any disclaimer, the term of this patent is extended or adjusted under 35 U.S.C. 154(b) by 1128 days.

(21) Appl. No.: 13/510,880

(22) PCT Filed: Nov. 18, 2010

(86) PCT No.: PCT/IB2010/002954

§ 371 (c)(1),
(2), (4) Date: Jul. 30, 2012

(87) PCT Pub. No.: WO2011/061605

PCT Pub. Date: May 26, 2011

(65) Prior Publication Data

US 2012/0288334 A1 Nov. 15, 2012

(30) Foreign Application Priority Data

Nov. 20, 2009 (IT) ..... MI2009A2044

(51) Int. Cl.
*E02F 5/10* (2006.01)
*B63B 35/03* (2006.01)
*E02F 5/14* (2006.01)

(52) U.S. Cl.
CPC ..... *E02F 5/104* (2013.01); *B63B 35/03* (2013.01); *E02F 5/145* (2013.01)

(58) Field of Classification Search
USPC ..... 405/158–160, 168.1
See application file for complete search history.

(56) References Cited

U.S. PATENT DOCUMENTS 3,670,514 A * 6/1972 Breston et al. ..... 405/160
3,877,237 A * 4/1975 Norman ..... 405/160
(Continued)

FOREIGN PATENT DOCUMENTS

DE 249 499 A1 9/1987
GB 1 492 151 A 11/1977
(Continued)

OTHER PUBLICATIONS http://web.archive.org/web/20070102222126/http://www.soest.hawaii.edu/gmt/ Wessel and Smith, Sep. 5, 2006.*
(Continued)

*Primary Examiner* — Anna M Momper
*Assistant Examiner* — Patrick F Lambe
(74) *Attorney, Agent, or Firm* — Sterne, Kessler, Goldstein & Fox P.L.L.C.

(57) ABSTRACT

A method of laying a pipeline in the bed of a body of water advancing a digging assembly along a pipeline laid along a path on the bed of the body of water, and digging a trench along the path in the bed of the body of water by means of the digging assembly, so a portion of pipeline settles onto the bottom of the trench. The method also includes acquiring, by means of the digging assembly, data related to the bathymetric profile of the portion of pipeline laid on the bottom of the trench, and comparing the acquired data with a set of permissible values. Further, the method includes emitting an error signal when the acquired data does not fall within the set of permissible values.

19 Claims, 4 Drawing Sheets

(56) References Cited

U.S. PATENT DOCUMENTS

| | | | | |
|---|---|---|---|---|
| 4,087,981 | A * | 5/1978 | Norman | 405/161 |
| 4,149,326 | A * | 4/1979 | Rosa et al. | 405/160 |
| 4,214,387 | A * | 7/1980 | Boehme et al. | 37/195 |
| 4,229,809 | A * | 10/1980 | Schwalbe | 367/6 |
| 4,586,850 | A * | 5/1986 | Norman et al. | 405/163 |
| 4,759,138 | A * | 7/1988 | Grinsted | 37/309 |
| 4,986,697 | A * | 1/1991 | Lynch | 405/165 |
| 5,689,475 | A * | 11/1997 | Chaumet-Lagrange | 367/88 |
| 5,691,903 | A * | 11/1997 | Racette, III | 701/21 |
| 5,947,051 | A * | 9/1999 | Geiger | 114/313 |
| 6,022,173 | A * | 2/2000 | Saxon | 405/163 |
| 6,719,494 | B1 * | 4/2004 | Machin | 405/163 |
| 6,771,563 | B1 * | 8/2004 | Bernard | 367/131 |
| 6,821,054 | B2 * | 11/2004 | Ballard | 405/159 |
| 6,837,653 | B1 * | 1/2005 | Grinsted | 405/161 |
| 7,117,091 | B2 * | 10/2006 | Masson et al. | 702/5 |
| 8,066,450 | B2 * | 11/2011 | Cocca | 405/171 |
| 8,328,466 | B1 * | 12/2012 | Shook et al. | 405/159 |
| 8,360,685 | B1 * | 1/2013 | Whiteside et al. | 405/160 |
| 2001/0010782 | A1 * | 8/2001 | Corbetta | 405/170 |
| 2002/0071724 | A1 * | 6/2002 | Reece | 405/159 |
| 2005/0232705 | A1 * | 10/2005 | Scainl et al. | 405/159 |
| 2010/0128561 | A1 * | 5/2010 | Meldahl et al. | 367/16 |
| 2010/0152901 | A1 * | 6/2010 | Judge et al. | 700/275 |
| 2010/0157736 | A1 * | 6/2010 | Riordan et al. | 367/88 |
| 2010/0182161 | A1 * | 7/2010 | Robbins et al. | 340/853.7 |

FOREIGN PATENT DOCUMENTS

| | | | |
|---|---|---|---|
| JP | 2008-208529 | A | 9/2008 |
| WO | WO 2005/005736 | A2 | 1/2005 |

OTHER PUBLICATIONS

M. Sinclair, Correcting Deep Spans in Subsea Pipelines, chap. 25 in PIPLINE 5, pp. 163-165 (Nov. 1985).

International Search Report and Written Opinion for International Appl. No. PCT/IB2010/002954, European Patent Office, The Netherlands, dated Mar. 25, 2011, 11 pages.

* cited by examiner

DIGGING METHOD AND ASSEMBLY FOR LAYING A PIPELINE IN THE BED OF A BODY OF WATER

TECHNICAL FIELD

The present invention relates to a method of laying a pipeline in the bed of a body of water.

More specifically, the method according to the present invention is of the type which comprises advancing a digging assembly along a pipeline laid along a path on the bed of the body of water; and digging a trench along the path in the bed of the body of water by means of the digging assembly, so a portion of the pipeline settles onto the bottom of the trench, substantially as described in the Applicant's Patent Application WO 2005/005736 A2.

BACKGROUND ART

The pipeline portion laid on the bottom of the trench does not always conform with project specifications, and, more specifically, varies in depth independently of variations in the depth of the bed of the body of water. This is a potentially serious problem that may result in severe mechanical stress when the pipeline is subjected to in-service temperature variations caused by weather or the fluid flowing along it.

Variations in the depth of the pipeline also result in shallow coverage and, hence, poor protection of the pipeline against scouring.

DISCLOSURE OF INVENTION

It is an object of the present invention to provide a method of laying a pipeline in the bed of a body of water, designed to eliminate the drawbacks of the known art.

A further object of the present invention is to provide a method of laying a pipeline in the bed of a body of water, designed to ensure precise conformance with design parameters.

According to the present invention, there is provided a method of laying a pipeline in the bed of a body of water, the method comprising the steps of:

- advancing a digging assembly along a pipeline laid along a path on the bed of the body of water;
- digging a trench along the path in the bed of the body of water by means of the digging assembly, so a portion of pipeline settles onto the bottom of the trench;
- acquiring, by means of the digging assembly, data related to the bathymetric profile of the portion of pipeline laid on the bottom of the trench;
- comparing the acquired data with a set of permissible values; and
- emitting an error signal when the acquired data does not fall within the set of permissible values.

According to the present invention, the data relating to the bathymetric profile of the pipeline portion laid on the bottom of the trench is acquired by the digging assembly itself, so fast, effective action can be taken by the digging assembly operators to correct the bottom of the trench in the event of anomalies or unacceptable deviations in the bathymetric profile with respect to project parameters.

More specifically, the data-acquiring step comprises acquiring, by means of the digging assembly, position coordinates and depth coordinates of the pipeline portion laid on the bottom of the trench; the depth coordinates preferably indicating the depth of the top of the pipeline.

In a preferred embodiment of the present invention, the data-acquiring step comprises interpolating the points identified by the position and depth coordinates into a curve, to define the bathymetric profile of the pipeline portion laid on the bottom of the trench; determining relative extremes of the curve; and calculating the variation in depth and the distance between each two consecutive relative extremes.

In another preferred embodiment, the method comprises acquiring position coordinates and depth coordinates of the bed of the body of water, to determine the bathymetric profile of the bed along the path; and calculating the coverage height of the pipeline portion laid on the bottom of the trench from the difference between the bathymetric profile of the bed along the path, and the bathymetric profile of the pipeline portion laid on the bottom of the trench. When filling in the trench, it is thus possible to monitor any anomalies in both the bathymetric profile and coverage height of the pipeline portion laid on the bottom of the trench, thus enabling operators to rectify both types of anomaly.

It is a further object of the present invention to provide a digging assembly designed to eliminate the drawbacks of the known art.

According to the present invention, there is provided a digging assembly for laying a pipeline in the bed of a body of water, the digging assembly being advanced along a path defined by a pipeline laid on the bed of a body of water, and comprising at least one digging machine for digging a trench along the path in the bed of the body of water, so a portion of pipeline settles onto the bottom of the trench; and a control device designed to acquire data related to the bathymetric profile of the portion of pipeline laid on the bottom of the trench; to compare the acquired data with a set of permissible values; and to emit an error signal when the acquired data does not fall within the set of permissible values.

BRIEF DESCRIPTION OF THE DRAWINGS

A non-limiting embodiment of the present invention will be described by way of example with reference to the attached drawings, in which.

THE DIGGING ASSEMBLY

Best Mode for Carrying Out the Invention

Figure 1:
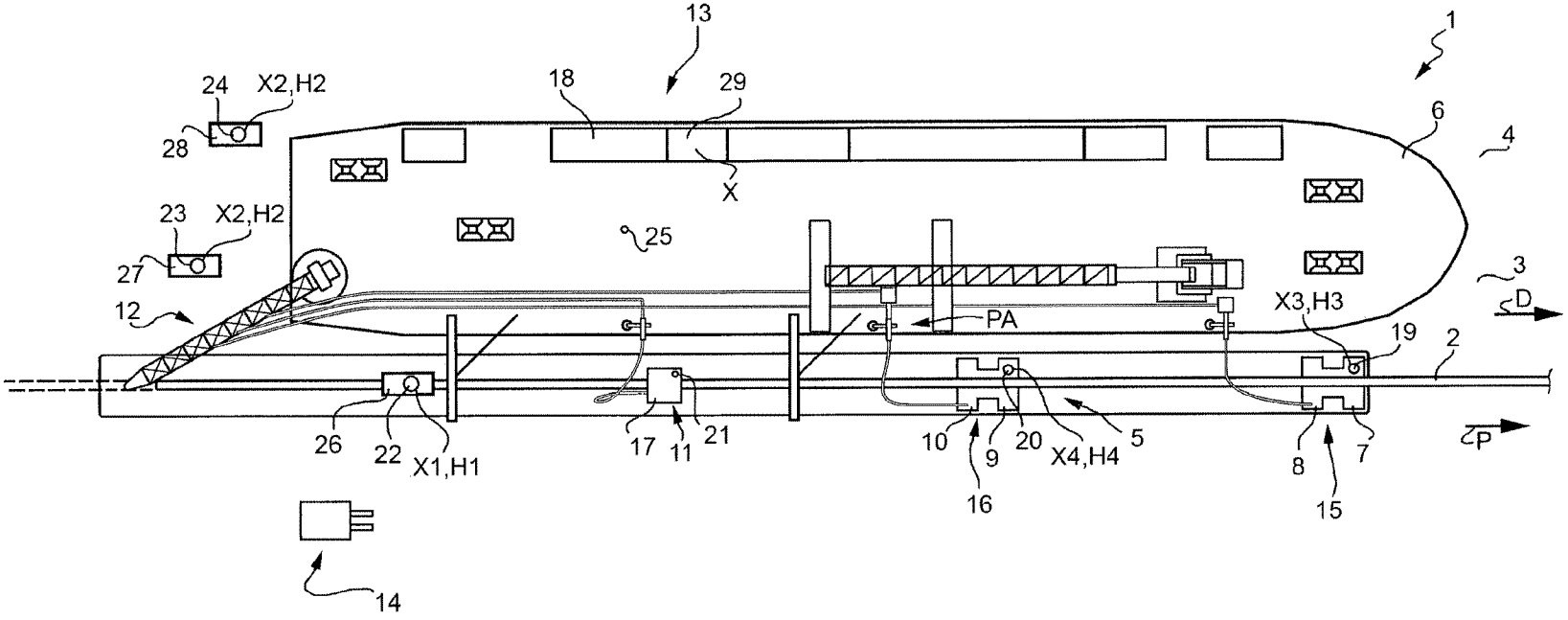
FIG. 1 shows a plan view of a digging assembly, in accordance with the present invention, burying a pipeline laid on the bed of a body of water.

Number 1 in FIG. 1 indicates as a whole a digging assembly for laying a pipeline 2 in the bed 3 of a body of water 4, and which, though not exclusively, is particularly suitable for burying a pipeline in shallow water (of less than 10 meters).

The following description refers specifically to digging assembly 1 operated in post-trenching mode, i.e. in which a trench 5 is dug close to pipeline 2 laid beforehand along a path P on bed 3 of body of water 4.

Pipeline 2 extends along path P on bed 3 of body of water 4, and digging assembly 1 is advanced along path P in a direction D parallel to path P and close to pipeline 2.

Digging assembly 1 comprises a support base 6 which, in the example shown, is a powered vessel moved in steps in direction D, parallel to path P; digging devices 7, 8, 9, 10 for forming trench 5; at least one backfill device 12 for filling in trench 5; a control device 13; and at least one grader 14 for modifying the bottom of trench 5 when control device 13 detects any anomalies, attributable to the bottom of trench 5, in the position of the portion of pipeline 2 laid on the bottom of trench 5.

Support base 6 is equipped with a pump assembly PA connected to digging devices 8, 10, 11—which, in the example shown, are dredging devices—and to backfill device 12 to pump the material removed from trench 5 onto support base 6 and to backfill device 12, which fills in trench 5 once pipeline 2 is laid on the bottom of trench 5.

Figure 2:
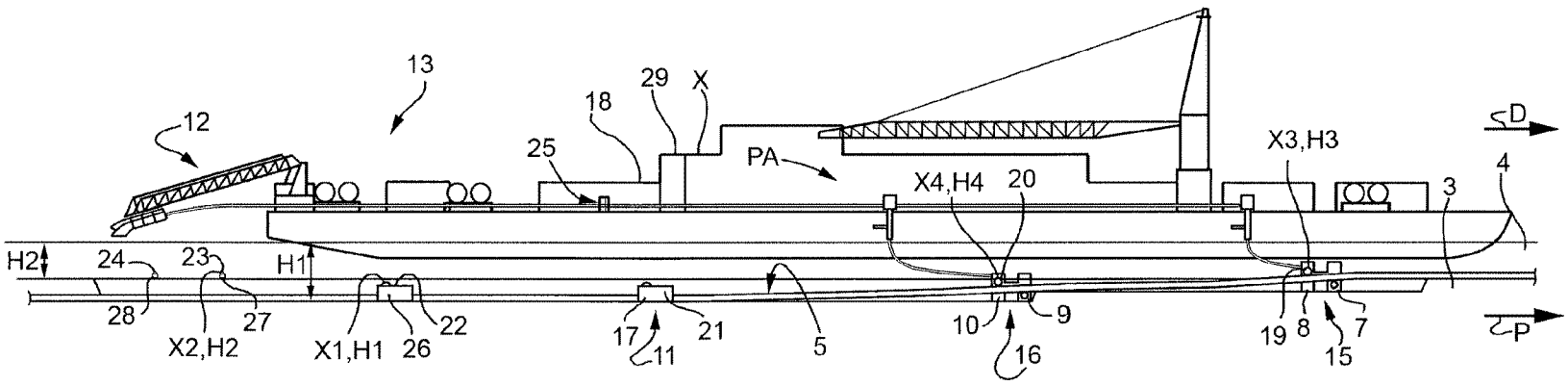
FIG. 2 shows a side view of the FIG. 1 digging assembly.

In the FIGS. 1 and 2 example, trench 5 is dug in two consecutive stages by two digging machines 15, 16, which comprise respective digging devices 7, 9 to break up bed 3 of body of water 4 close to—in the example shown, underneath—pipeline 2; and respective digging devices 8, 10 for dredging the material broken up by digging devices 7, 9. Digging machine 16 operates deeper than and downstream from digging machine 15 in travelling direction D. Digging machines 15, 16 are connected to support base 6 by umbilicals (not shown) by which control signals and operating power are transmitted in known manner. The umbilicals allow digging machines 15, 16 a certain amount of movement with respect to support base 6, though the positions of digging machines 15, 16 with respect to support base 6 are more or less constant, and only vary by a few meters along path P.

Trench 5 is dug beneath pipeline 2 laid on bed 3 of body of water 4; and pipeline 2 settles gradually onto the bottom of trench 5 as it is dug. In the FIG. 2 configuration, pipeline 2 has a portion laid on bed 3 of body of water 4; a portion laid on the bottom of trench 5; and an unsupported portion inside trench 5. As trench 5 is dug in direction D, the unsupported portion gradually settles onto the bottom of trench 5, and support is gradually removed from beneath the portion on bed 3 of body of water 4.

The length of the unsupported portion depends on the physical, mechanical, and dimensional characteristics of pipeline 2, and on the depth of trench 5. And, on the basis of these parameters, it is possible to determine the point at which pipeline 2 rests on the bottom of trench 5.

Digging device 11 comprises a carriage 17 which is movable along pipeline 2, is located along the unsupported portion of pipeline 2, and is substantially a dredging device connected to the pump assembly PA on support base 6. Digging device 11 is also connected to support base 6 by an umbilical (not shown), is allowed a limited amount of movement along path P with respect to support base 6, and is an emergency dredging device, which is operated to remove collapsed sidewall material from the bottom of trench 5 and restore the bottom of trench 5 to design conditions. This is a routine occurrence when working with a loose bed 3 of body of water 4 and a steep-sidewalled trench 5.

Control device 13 comprises a control unit 18 on support base 6; and sensors 19, 20, 21, 22, 23, 24, 25 connected functionally to control unit 18, and which are substantially pressure sensors for supplying signals to control unit 18. In the example shown, sensor 19 is fitted to digging machine 15; sensor 20 to digging machine 16; sensor 21 to carriage 17 of emergency digging device 11; sensor 22 to a carriage 26 movable along the portion of pipeline 2 laid on the bottom of trench 5; sensors 23, 24 to respective slides 27, 28 on bed 3 of body of water 4; and sensor 25 to support base 6. Control device 13 comprises a position recognition system 29—in the example shown, a GPS—for acquiring data related to the position coordinates of digging assembly 1. Position recognition system 29 and control unit 18 are configured to supply a position coordinate X indicating the distance travelled by digging assembly 1 along path P with respect to a reference point on pipeline 2—normally the trench backfill start point. Given that the component parts of digging assembly 1 are advanced more or less in the same way as and simultaneously with support base 6, the X coordinate also roughly indicates the position of each of the component parts of digging assembly 1.

Sensor 25 on the support base serves to determine atmospheric pressure by which to calibrate the other sensors. Sensors 19, 20, 21, 22, 23, 34 supply pressure data related to the respective depths of digging machine 15, digging machine 16, digging device 11, carriage 26, and slides 27 and 28, to enable control unit 18 to supply respective depth values of digging machine 15, digging machine 16, digging device 11, carriage 26, and slides 27, 28 for each X position coordinate.

In a preferred embodiment of the present invention, control device 13 operates more accurately by acquiring the coordinate of digging machine 15, the coordinate of digging machine 16, the coordinate of digging device 11, the coordinate of carriage 26, and the coordinates of slides 27 and 28. Given the X position coordinate of support base 6, the above coordinates are relatively easy to acquire by simply adding (or subtracting) a fixed distance of each of the above components to (or from) the X position coordinate value. The positions of digging machines 15 and 16, emergency digging device 11, carriage 26 and slides 27 and 28, in fact, only vary by a few meters in direction D with respect to support base 6, so for this purpose may be considered fixed relative positions. This is a feasible approximation, considering that known position recognition systems are only accurate to within a few meters, and only a few types provide for greater precision, but at considerable cost. Nevertheless, in a variation not shown, control device 13 comprises a position recognition system for carriage 26, and position recognition devices for slides 27 and 28. In another variation not shown, each digging machine 15, 16 has its own position recognition device.

Control device 13 uses the data it acquires to calculate the straightness of pipeline 2 laid on the bottom of trench 5, or the extent to which arching of pipeline 2 is acceptable; the coverage height of pipeline 2; the operating depth of digging machines 15 and 16; and the depth of digging machine 11.

The above parameters serve to rectify any anomalies detected by control device 13.

Straightness Control of the Pipeline Laid on the Bottom of the Trench

When pipeline 2, or a portion of it, is laid on the bottom of trench 5, the pipeline assumes a bathymetric profile which depends on the bottom of trench 5 and the mechanical characteristics of pipeline 2. Straightness control ensures pipeline 2, or rather the portion of it, laid on the bottom of trench 5 has no critical points along its bathymetric profile capable of initiating abnormal deformation which could undermine the structural integrity of pipeline 2 once it is operative. For this purpose, pairs of permissible geometric values of pipeline 2 are defined, each pair comprising a permissible variation in depth of pipeline 2, and a permissible length of deformation along pipeline 2.

Figure 4:
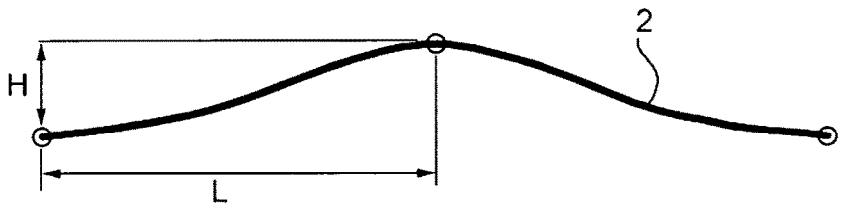
FIG. 4 shows a diagram of typical arching of an in-trench pipeline.

Arching—in this case, in the vertical plane of the pipeline—is considered a critical form of deformation, by possibly causing structural instability of the pipeline. An arching model is shown in FIG. 4. In short, pipeline 2 forms an arch, the dimensions of which are defined by two consecutive (in this case, minimum and maximum) relative extremes, and characterized by a variation in depth H, and by a distance L between consecutive relative extremes (from minimum to maximum and/or vice versa). In actual fact, arching extends to a length of roughly twice distance L.

Figure 5:
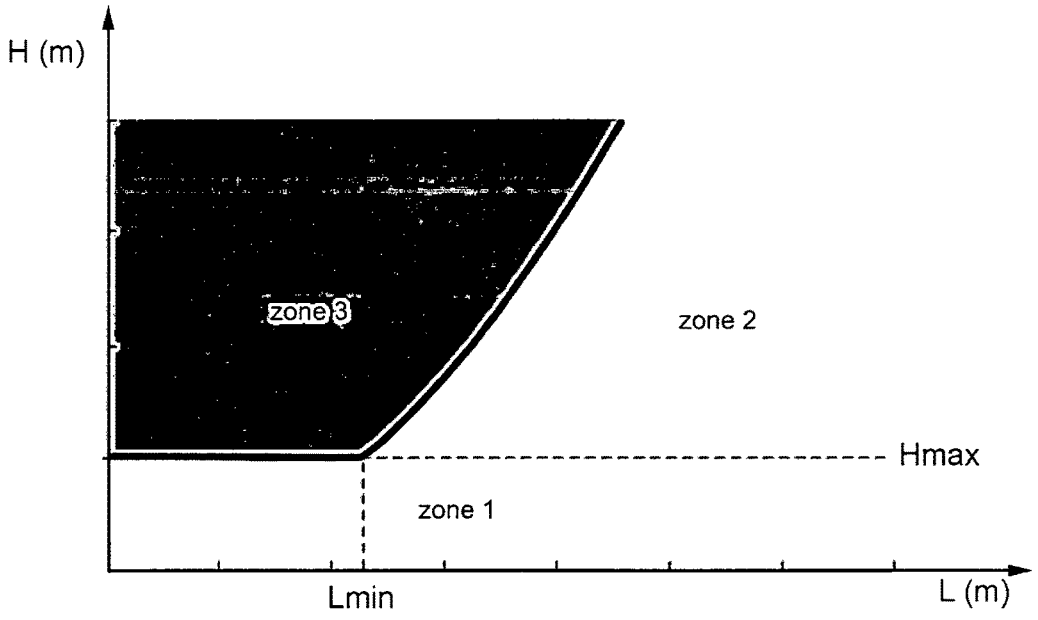
FIG. 5 shows a graph of a boundary curve separating permissible from non-permissible pipeline deformation values.

With reference to FIG. 5, permissible variations in depth H and distance L are defined according to the physical, mechanical and dimensional characteristics of pipeline 2, which include the type of material, thickness, and diameter of the pipes used to build pipeline 2, and the dimensional characteristics of any covering of pipeline 2. FIG. 5 shows an example of pairs of permissible values (zone 1 and zone 2). In this case, the mechanical characteristics of the pipeline and simulation tests show that, below a given distance value $L_{min}$, the maximum permissible variation in depth is constant and equals a value $H_{max}$, whereas, above distance value $L_{min}$ the maximum permissible variation in depth increases with distance L. Zones 1 and 2 define the permissible values, and zone 3 the non-permissible values.

Figure 6:
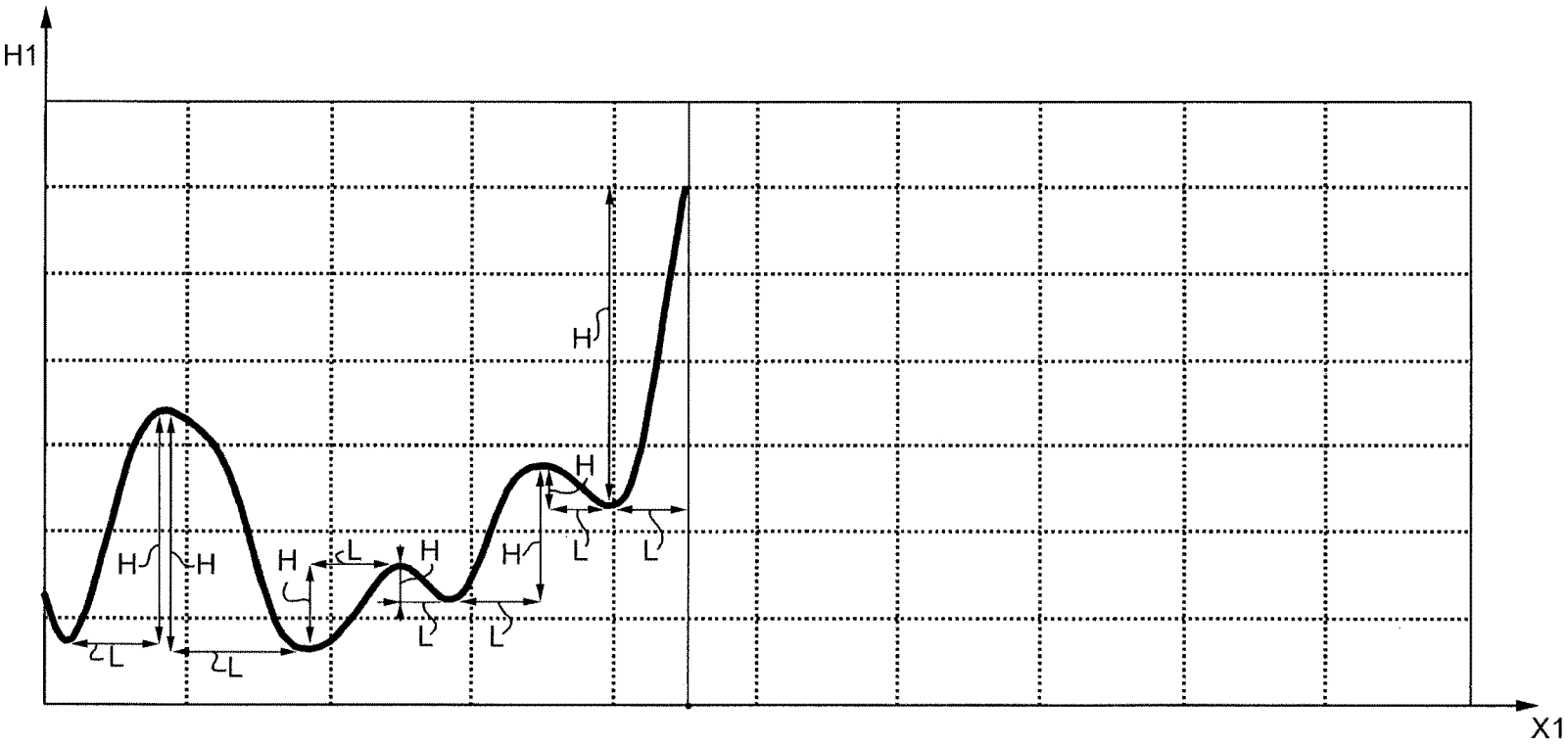
FIG. 6 shows a graph, in which the Y axis shows the distance of the pipeline from a reference point along the pipeline, and the X axis the depth of the pipeline.

With reference to FIG. 2, the method according to the present invention comprises acquiring data related to the bathymetric profile of the portion of pipeline 2 laid on the bottom of trench 5 at preferably regular intervals. This digitized data is processed by control unit 18 and, for easy interpretation, is plotted on a cartesian graph of the type shown in FIG. 6, in which the Y axis shows position coordinate X1 and the X axis depth coordinate H1. Control unit 18 may be equipped with a monitor and printer (not shown) to show the bathymetric profile of the portion of pipeline 2 laid on the bottom of trench 5. The data acquired is the position coordinate X1 indicating the distance, along path P, between a reference point on pipeline 2 and the acquired point; and depth coordinate H1 indicating the depth of pipeline 2 at the position coordinate X1 point. Control unit 18 is configured to interpolate the points indicated by position and depth coordinates X1 and H1 into a curve, preferably composed of third-order polynomial curves with continuity up to the second derivative at the connecting points of different polynomial curves. (Spath H. 1974: "Spline Algorithms for Curves and Surfaces, Utilitas Mathematica Publishing Inc.).

Control unit 18 is configured to acquire the relative extremes of the curve; calculate the variation in depth H, and distance L between each pair of consecutive relative extremes; and compare the pairs of H and L values with the pairs of permissible values in FIG. 5. Each pair of H and L values indicates the presence of arching of pipeline 2, and is comparable with the pairs of permissible values.

Control unit 18 is configured to real-time calculate the H and L data relative to the last relative extreme, and the last acquired position and depth coordinates X1 and H1, which may identify a relative extreme and so indicate a critical condition of pipeline 2.

When the acquired H and L data does not fall within the permissible values in FIG. 5, i.e. within zone 3 in the FIG. 5 graph, control unit 18 emits an error signal E1 preferably related to the degree of error, i.e. the extent to which the H and L data deviates from the permissible values.

The availability of a real-time error signal E1 indicating non-linearity of pipeline 2 enables immediate steps to be taken to level the bottom portion of trench 5 causing the non-linearity of pipeline 2, before trench 5 is filled in.

Error signal E1 determines an emergency situation, during which digging and backfilling may be suspended, support base 6 stopped in a given position, and the FIG. 1 grader 14 operated to level the bottom of trench 5. Grader 14 is substantially a remotely-operated underwater vehicle connected by umbilicals (not shown) to support base 6 and equipped with dredging tools, which are set up on either side of pipeline 2 to create conditions whereby pipeline 2 sinks further into trench 5, and so correct the bathymetric profile of pipeline 2. The bottom of trench 5 is preferably levelled before trench 5 is filled in.

Other devices, such as the one described in the Applicant's Patent Application WO 00/60178, may be substituted for grader 14.

Pipeline Coverage Height Control

Figure 3:
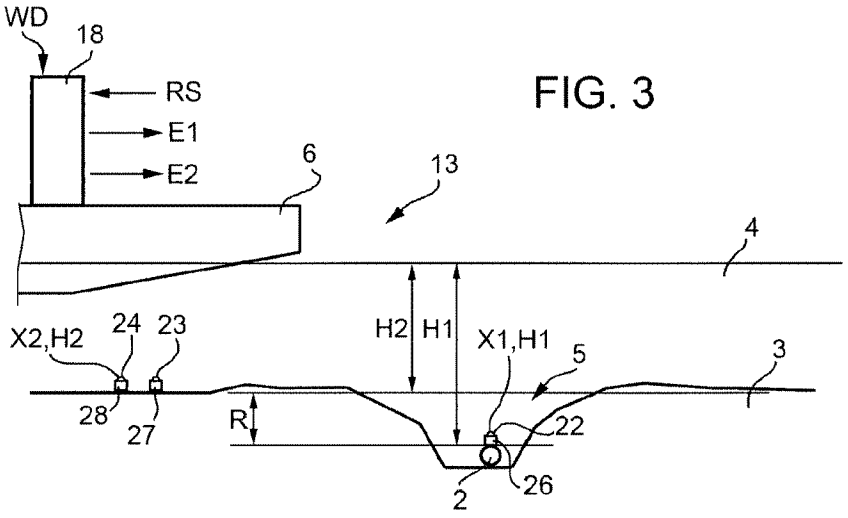
FIG. 3 shows a front view of the FIG. 1 assembly and a trench formed in the bed of the body of water.

With reference to FIG. 3, sensor 22 on carriage 26 supplies data relative to depth coordinate H1 of the top of pipeline 2; and sensors 23 and 24 on respective slides 27 and 28 supply data relative to a coordinate H2 related to the surface depth of bed 3 of body of water 4. One of sensors 23, 24 would be enough to measure the depth of bed 3, but multiple sensors give a more accurate measurement, especially in the event of a highly uneven surface of bed 3. The depth of bed 3 is substantially measured close to path P, so the acquired depth data may be taken as applying to the depth of bed 3 at path P.

The bathymetric profile of bed 3 is substantially acquired along or close to path P (FIG. 2). Control unit 18 is configured to calculate the coverage height R of pipeline 2 as the difference between depth coordinate H1 related to the top of pipeline 2, and coordinate H2 related to the depth of bed 3; and to compare coverage height R with a threshold value RS defining a set of permissible coverage height R values. When the calculated coverage height R is below threshold value RS, control unit 18 emits an error signal E2.

Depth coordinate H1 is associated with a position coordinate X1, and depth coordinate H2 is associated with a position coordinate X2 defined by the distance, along path P, between slides 27, 28 and a reference point on pipeline 2 along path P. The subtraction of depth coordinates H1 and H2 must be made for respective position coordinate X1 and X2 values within a given confidence interval, i.e. relatively close and preferably coincident.

On the basis of error signal E2, grader 14 (FIG. 1) intervenes to lower the position of pipeline 2 in trench 5 to such a depth coordinate H1 that the calculated coverage height R is greater than or equal to threshold value RS; and the sinking of the bottom of trench 5 is monitored to ensure it does not jeopardize the straightness of pipeline 2.

Emission of error signal E2 may also be followed by a signal to digging machines 15, 16 to correct, if necessary, the digging depth of machines 15, 16 (FIG. 1).

In other words, control unit 18 acquires the bathymetric profile of bed 3, and compares it with the bathymetric profile of the portion of pipeline 2 laid on the bottom of trench 5, to ensure coverage height R falls within permissible values along the whole of path P.

Digging Machine Depth Control

With reference to FIG. 2, by means of sensors 19 and 20, control device 13 monitors respective depth coordinates H3 and H4 of digging machines 15 and 16 to determine conformance with design depths. Depth coordinates H3 and H4 of digging machines 15 and 16 are related to depth coordinate H2 of bed 3 of body of water 4 to calculate the depth of trench 5 with respect to the surface of bed 3 and ensure sufficient coverage height R (not shown). Depth coordinates H3, H4 are paired with respective position coordinates X3, X4 indicating the distances, along path P, between respective digging machines 15, 16 and a reference point on pipeline 2. In this case, too, the operating depth of digging machines 15, 16 must be calculated for pairs of position coordinates X2, X3 and pairs of position coordinates X2, X4 within a confidence interval to obtain significant results.

The same also applies to calculating the position coordinates along path P and the depth coordinates of emergency digging device 11, which is located along, and supplies information about flexure of, the unsupported portion of pipeline 2.

Advantages

Digging assembly 1 according to the present invention provides for monitoring various parameters, and for making any necessary corrections when the monitored parameters fail to conform with design specifications.

Fast detection of any anomalies with respect to design parameters enables resetting of digging assembly 1 to prevent the anomalies from being repeated, and immediate action to eliminate the causes.

As such, digging assembly 1 provides for laying pipeline 2 in bed 3 of body of water 4 with a sufficient degree of straightness and sufficient coverage height R.

Clearly, changes may be made to the embodiment of the present invention as described herein without, however, departing from the protective scope of the accompanying Claims.

The invention claimed is:

1. A method of laying a pipeline in the bed of a body of water, the method comprising the steps of:

advancing a digging assembly along a pipeline laid along a path on the bed of the body of water;

digging a trench along the path in the bed of the body of water by means of the digging assembly, so a portion of pipeline settles onto the bottom of the trench;

acquiring, by means of the digging assembly, data related to the bathymetric profile of the portion of pipeline laid on the bottom of the trench, the data including the depth of the portion of pipeline laid on the bottom of the trench;

comparing the acquired data with a set of permissible values indicating permissible arching of the pipeline in a vertical plane;

emitting an error signal when the acquired data does not fall within the set of permissible values; and modifying a depth of the trench as a function of the error signal to modify arching of the pipeline in the vertical plane.

2. A method as claimed in claim 1, wherein the step of acquiring data comprises acquiring, by means of the digging assembly, first coordinates of the portion of pipeline laid on the bottom of the trench, the first coordinates indicating the distance, along the path, from a reference point on the pipeline; and second coordinates indicating the depth of the portion of pipeline laid on the bottom of the trench.

3. A method as claimed in claim 2, wherein the step of acquiring data comprises acquiring the first and second coordinates as the digging assembly advances along the path.

4. A method as claimed in claim 3, wherein the step of acquiring data comprises interpolating the points defined by the first and second coordinates into a curve to define the bathymetric profile of the portion of pipeline laid on the bottom of the trench.

5. A method as claimed in claim 4, wherein the step of acquiring data comprises determining relative extremes of the curve; and calculating the variation in depth and the distance between each pair of consecutive relative extremes.

6. A method as claimed in claim 5, wherein the step of acquiring data comprises determining the relative extremes of the curve; and calculating the variation in depth and the distance between the last relative extreme and the last acquired first coordinate.

7. A method as claimed in claim 5, further comprising the step of comparing the calculated variation in depth and the calculated distance with the set of permissible values.

8. A method as claimed in claim 2, wherein the step of acquiring data comprises acquiring, by means of the digging assembly, third coordinates of the bed, the third coordinates indicating the distance, along the path, from a reference point on the pipeline; and fourth coordinates indicating the depth of the bed of the body of water, so as to determine the bathymetric profile of the bed along the path.

9. A method as claimed in claim 8, further comprising the steps of:

calculating the differences between the second coordinates and the fourth coordinates, when the respective first coordinates and third coordinates are within a confidence interval; the differences being related to the coverage height of the pipeline;

comparing the differences with a threshold value defining a set of permissible values; and emitting a second error signal when at least one of the differences is below the threshold value.

10. A method as claimed in claim 1, further comprising the step of defining the set of permissible values as a function of the physical, mechanical, and dimensional characteristics of the pipeline.

11. A method as claimed in claim 10, wherein the set of permissible values comprises pairs of values indicating permissible variations in depth and permissible lengths of deformation along the pipeline.

12. A method as claimed in claim 1, further comprising the step of filling in the trench.

13. A digging assembly for laying a pipeline in the bed of a body of water, the digging assembly being advanced along a path defined by a pipeline laid on the bed of a body of water, the digging assembly comprising:

at least one digging machine configured to dig a trench in the bed of the body of water, close to the pipeline, so a portion of pipeline settles onto the bottom of the trench; and a control device configured to acquire data related to the bathymetric profile of the portion of pipeline laid on the bottom of the trench, to compare the acquired data with a set of permissible values indicating permissible arching of the pipeline in a vertical plane, and to emit an error signal when the acquired data does not fall within the set of permissible values, wherein the acquired data indicates the depth of the portion of pipeline laid on the bottom of the trench; and wherein the digging assembly is configured to modify a depth of the trench as a function of the error signal to modify arching of the pipeline in the vertical plane.

14. A digging assembly as claimed in claim 13, wherein the control device comprises:

at least one position recognition device configured to acquire first coordinates of the portion of pipeline laid on the bottom of the trench, the first coordinates indicating the distance, along the path, from a reference point on the pipeline;

a first sensor configured to acquire second coordinates indicating the depth of the portion of pipeline laid on the bottom of the trench; and a control unit having a memory for storing the first and second coordinates and the set of permissible values comprising pairs of values indicating the permissible variation in depth of a deformation of the pipeline, and the permissible length of the deformation of the pipeline.

15. A digging assembly as claimed in claim 14, wherein the control unit is configured to:

acquire the first and second coordinates; and interpolate the points defined by the first and second coordinates into a curve indicating the bathymetric profile of the portion of pipeline laid on the bottom of the trench.

16. A digging assembly as claimed in claim 15, wherein the control unit is configured to:

acquire relative extremes of the curve;

calculate the variation in depth and the distance between each pair of consecutive relative extremes; and calculate the variation in depth and the distance between the last relative extreme and the last acquired first and second coordinates.

17. A digging assembly as claimed in claim 16, wherein the control unit is configured to compare the calculated variation in depth and the calculated distance with a set of permissible values.

18. A digging assembly as claimed in claim 13, wherein the control device comprises at least one second sensor configured to acquire third coordinates of the bed, the third coordinates indicating the distance, along the path, from a reference point on the pipeline, and to acquire fourth coordinates indicating the depth of the bed of the body of water, along the path, so as to determine the bathymetric profile of the bed along the path.

19. A digging assembly as claimed in claim 18, wherein the control unit is configured to:

calculate the differences between the second coordinates and the fourth coordinates, when the respective first coordinates and third coordinates are within a confidence interval; the differences being related to the coverage height of the portion of pipeline laid on the bottom of the trench;

compare the differences with a threshold value defining the set of permissible values; and emit a second error signal when at least one of the differences is below the threshold value.

* * * * *